US009981162B2

(12) United States Patent
Abe et al.

(10) Patent No.: US 9,981,162 B2
(45) Date of Patent: May 29, 2018

(54) GOLF CLUB HEAD

(71) Applicant: DUNLOP SPORTS CO. LTD., Kobe-shi, Hyogo (JP)

(72) Inventors: Hiroshi Abe, Kobe (JP); Daisuke Kohno, Kobe (JP)

(73) Assignee: DUNLOP SPORTS CO. LTD., Kobe-shi, Hyogo (JP)

( * ) Notice: Subject to any disclaimer, the term of this patent is extended or adjusted under 35 U.S.C. 154(b) by 0 days. days.

(21) Appl. No.: 15/176,412

(22) Filed: Jun. 8, 2016

(65) Prior Publication Data

US 2016/0361614 A1 Dec. 15, 2016

(30) Foreign Application Priority Data

Jun. 9, 2015 (JP) ..... 2015-117059

(51) Int. Cl.
*A63B 53/04* (2015.01)
*A63B 53/06* (2015.01)
*A63B 60/00* (2015.01)

(52) U.S. Cl.
CPC .. *A63B 53/0466* (2013.01); *A63B 2053/0433* (2013.01); *A63B 2053/0491* (2013.01); *A63B 2060/002* (2015.10)

(58) Field of Classification Search
CPC ..... A63B 2053/0491
USPC ..... 473/324–350
See application file for complete search history.

(56) References Cited

U.S. PATENT DOCUMENTS 985,194 A * 2/1911 McLaren ..... A63B 53/04 473/338
1,518,316 A * 12/1924 Ellingham ..... A63B 53/0487 473/337
6,773,360 B2 * 8/2004 Willett ..... A63B 53/0466 473/334
6,991,558 B2 * 1/2006 Beach ..... A63B 53/04 473/324
7,153,220 B2 * 12/2006 Lo ..... A63B 53/0466 473/335
7,273,423 B2 * 9/2007 Imamoto ..... A63B 53/0466 473/332
7,530,903 B2 * 5/2009 Imamoto ..... A63B 53/0466 473/335

(Continued)

FOREIGN PATENT DOCUMENTS

JP 5678004 B2 2/2015

*Primary Examiner* — Alvin Hunter
(74) *Attorney, Agent, or Firm* — Birch, Stewart, Kolasch & Birch, LLP

(57) ABSTRACT

Provided is a golf club head capable of realizing a lower center of gravity without a weight member protruding from a sole portion. The golf club head according to the present invention includes a crown portion, a face portion, and a sole portion having at least one recessed portion. The recessed portion is configured to house the weight member such that the weight member does not protrude externally. The sole portion is provided with a raised portion including the recessed portion and protruding downward, and to be at least partially placed on a placement surface in a reference state. A center of the recessed portion is arranged further to a back side in a face-back direction and to a heel side in a toe-heel direction than a center of gravity of the head.

10 Claims, 6 Drawing Sheets

(56) References Cited

U.S. PATENT DOCUMENTS 7,530,904 B2 * 5/2009 Beach ..... A63B 53/0466 473/337
7,572,193 B2 * 8/2009 Yokota ..... A63B 53/0466 473/328
7,572,194 B2 * 8/2009 Yamamoto ..... A63B 53/0466 473/334
7,637,823 B2 * 12/2009 Shimazaki ..... A63B 53/0466 473/332
7,771,290 B2 * 8/2010 Bezilla ..... A63B 53/0466 473/335
7,824,277 B2 * 11/2010 Bennett ..... A63B 53/0466 473/328
7,824,280 B2 * 11/2010 Yokota ..... A63B 53/0466 473/334
7,871,339 B2 * 1/2011 Sanchez ..... A63B 53/0466 473/335
8,012,042 B2 * 9/2011 Abe ..... A63B 53/0466 473/345
8,016,694 B2 * 9/2011 Llewellyn ..... A63B 53/0466 473/334
8,123,626 B2 * 2/2012 Cackett ..... A63B 53/0466 473/242
8,197,357 B1 * 6/2012 Rice ..... A63B 53/0466 473/334
8,202,175 B2 * 6/2012 Ban ..... A63B 53/0466 473/334
8,246,488 B2 * 8/2012 Stevens ..... A63B 53/04 473/335
8,257,196 B1 * 9/2012 Abbott ..... A63B 53/0466 473/335
8,337,319 B2 * 12/2012 Sargent ..... A63B 53/02 473/246
8,480,511 B2 * 7/2013 Sargent ..... A63B 53/0466 427/331
8,696,488 B2 * 4/2014 Burnett ..... A63B 53/02 473/246
8,876,633 B2 * 11/2014 Matsunaga ..... A63B 53/06 473/311
8,894,506 B1 * 11/2014 Myers ..... A63B 53/0466 473/334
9,168,430 B2 * 10/2015 Mizutani ..... A63B 53/0466
9,265,994 B2 * 2/2016 Mizutani ..... A63B 53/0466
9,327,173 B2 * 5/2016 Mizutani ..... A63B 53/06
9,358,431 B2 * 6/2016 Yamamoto ..... A63B 53/04
9,364,724 B2 * 6/2016 Motokawa ..... A63B 53/02
9,403,069 B2 * 8/2016 Boyd ..... A63B 53/0466
9,421,438 B2 * 8/2016 Beno ..... A63B 60/42
9,586,101 B2 * 3/2017 Motokawa ..... A63B 53/04
9,636,553 B1 * 5/2017 Myers ..... A63B 53/0466
9,682,296 B1 * 6/2017 Myers ..... A63B 53/0466
2013/0005504 A1 1/2013 Ferguson et al.

* cited by examiner

Cross-section E1

GOLF CLUB HEAD

CROSS REFERENCE TO RELATED APPLICATION

This application claims a priority to Japanese Patent Application No. 2015-117059 filed on Jun. 9, 2015, which is hereby incorporated by reference in its entirety.

FIELD OF INVENTION

The present invention relates to a golf club head.

BACKGROUND OF THE INVENTION

In recent years, various golf club heads provided with a weight member in a sole portion thereof have been proposed. For example, in the golf club head disclosed in JP 5678004, the sole portion has a weight member that extends out past the natural outline of the golf club head. This weight member is arranged, however, so as to not be visible to the golfer when he or she in the address position.

However, the weight member protrudes from the sole portion of the golf club head, and thus there is a concern that the weight member will catch on the ground when the golf club head is swung. Also, the weight member is attached with the object of lowering the center of gravity of the head, but to lengthen the flight distance, there is demand for a golf club head with an even lower center of gravity. The present invention was made in order to resolve these problems, and an object thereof is to provide a golf club head with which a lower center of gravity can be realized without a weight member protruding from the sole portion.

SUMMARY of INVENTION

A golf club head according to the present invention includes a crown portion, a face portion, and a sole portion having at least one recessed portion. The recessed portion is configured to house a weight member such that the weight member does not protrude externally, the sole portion is provided with a raised portion that includes the recessed portion, protrudes downward and is at least partially placed on a placement surface in a reference state, and a center of the recessed portion is arranged further to a back side in a face-back direction and to a heel side in a toe-heel direction than a center of gravity of the head.

The above golf club head can be configured such that the raised portion is surrounded by a first edge portion that runs along a vicinity of a boundary between the sole portion and the face portion, a second edge portion that extends from the heel side to a vicinity of a midpoint in the toe-heel direction, along a vicinity of a boundary between the sole portion and the crown portion, and a third edge portion that joins an end portion of the second edge portion on a toe side and an end portion of the first edge portion on the toe side.

Each of the above golf club heads can be configured such that the second edge portion has a protruding portion formed by a part of a peripheral edge of the recessed portion protruding on the heel side.

Each of the above golf club heads can be configured to further include a weight member and a decoration member to be arranged in the recessed portion, and such that the decoration member is fixed in the recessed portion by the weight member.

Each of the above golf club heads can be configured such that, when the head in the reference state is seen in back view, at least 60% of an area of the raised portion is arranged further to the heel side than a line extending in the face-back direction through a furthest point on the back side of the sole portion.

With a golf club head according to an one aspect of embodiment, a lower center of gravity can be realized without the weight member protruding from the sole portion.

DETAILED DESCRIPTION OF THE PREFERRED EMBODIMENTS

Figure 1:
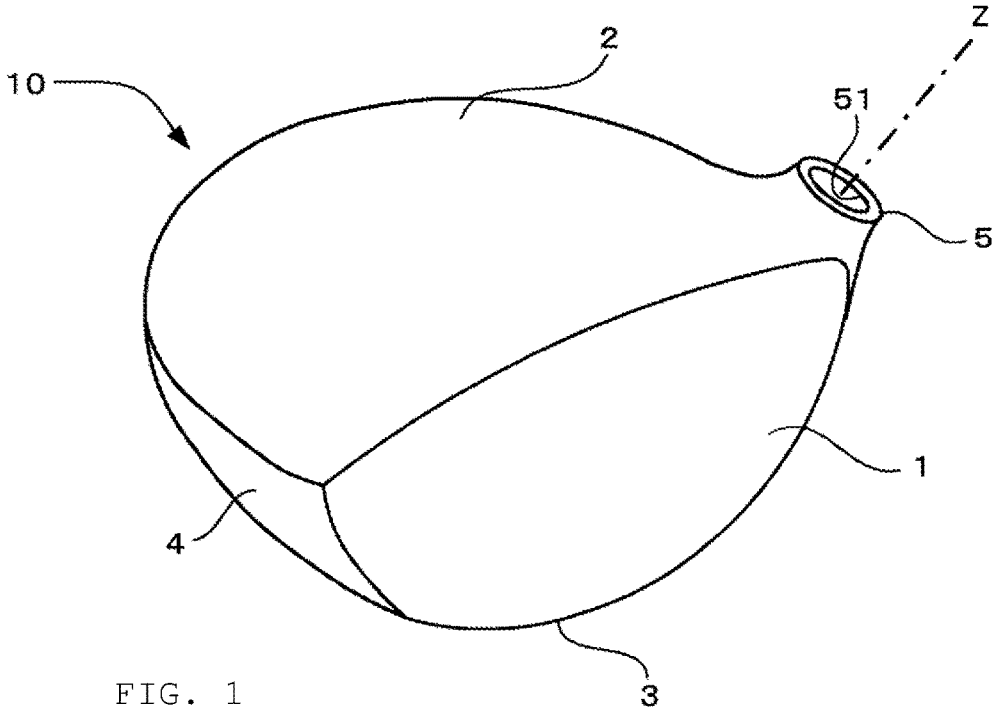
FIG. 1 is a perspective view of a reference state in one embodiment of a golf club head according to the present invention.
Figure 2:
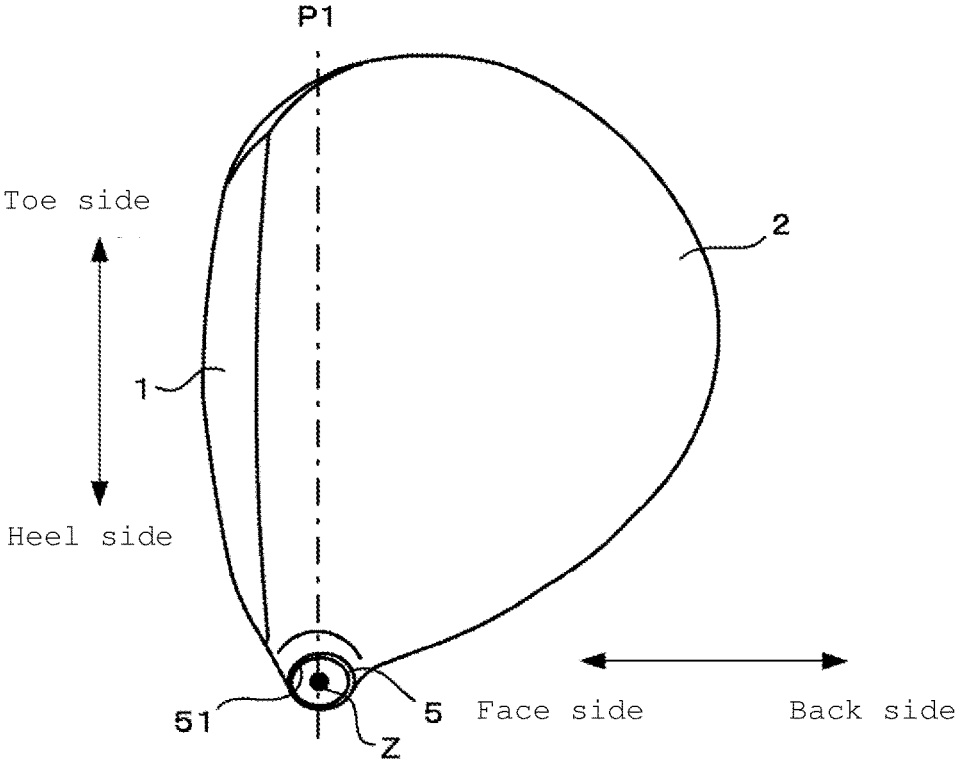
FIG. 2 is a plan view of FIG. 1.

An embodiment of a golf club head according to the present invention will be described below with reference to the drawings. FIG. 1 is a perspective view of the golf club head according to the present embodiment, and FIG. 2 is a plan view of FIG. 1. Hereinafter, an overview of the golf club head will be described first, and then a decoration member and a fixing member provided to the golf club head will be described.

1. Overview of Golf Club Head

As shown in FIG. 1, this golf club head (hereinafter, may be referred to as simply the "head") 10 has a hollow structure with an internal space, and wall surfaces thereof are formed by a face portion 1, a crown portion 2, a sole portion 3, a side portion 4, and a hosel portion 5.

The face portion 1 has a face surface, which is the surface that hits the ball, and the crown portion 2 is adjacent to the face portion 1 and constitutes the upper surface of the head. The sole portion 3 constitutes the bottom surface of the head, and is adjacent to the face portion 1 and the side portion 4. Also, the side portion 4 is the region between the crown portion 2 and the sole portion 3, and extends from the toe side of the face portion 1 to the heel side of the face portion 1 across the back side of the head. Furthermore, the hosel portion 5 is the region provided adjacent to the heel side of the crown portion 2, and has an insertion hole 51 for insertion of the shaft (not shown) of the golf club. A central axis Z of the insertion hole 51 coincides with the axis of the shaft.

The following describes the aforementioned reference state. First, as shown in FIGS. 1 and 2, a state in which the central axis Z is in a plane P1 that is perpendicular to a ground H (placement surface; see FIG. 5) and the head is placed on the ground at a predetermined lie angle and real loft angle is prescribed as the reference state. The plane P1 will be referred to as a reference perpendicular plane. Also, as shown in FIG. 2, the direction of the line of intersection of the reference perpendicular plane P1 and the ground will be referred to as the toe-heel direction, and the direction that is perpendicular to the toe-heel direction and parallel to the ground will be referred to as the face-back direction.

Figure 3A:
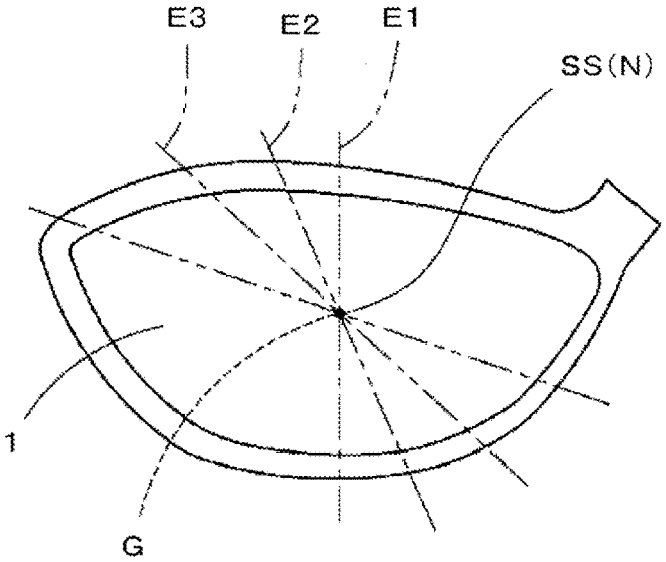
FIGS. 3A and 3B are diagrams illustrating a boundary of a face portion.
Figure 3B:
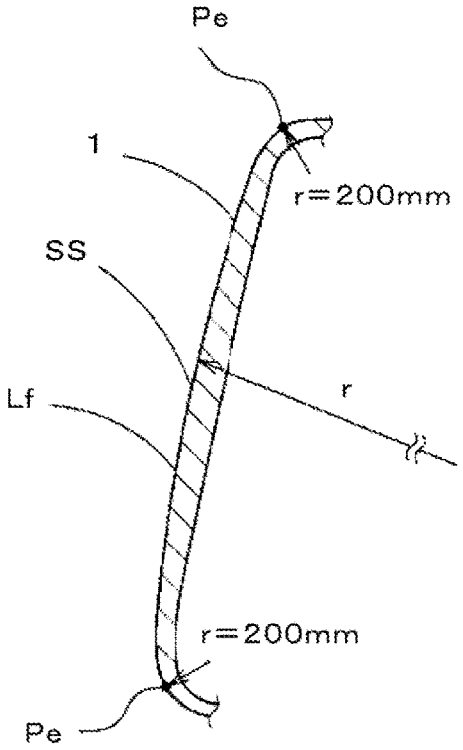

In the present embodiment, the boundary between the crown portion 2 and the side portion 4 can be defined as follows. Specifically, if a ridge line is formed between the crown portion 2 and the side portion 4, that ridge line serves as the boundary. In contrast, if a clear ridge line is not formed, the boundary is the outline that is seen when the head is placed in the reference state and viewed from directly above the center of gravity of the head. Similarly, in the case of the boundary between the face portion 1 and the crown portion 2 and between the face portion 1 and the sole portion 3, if a ridge line is formed, that ridge line serves as the boundary. However, if a clear ridge line is not formed, the peripheral edge (boundary) of the face portion 1 is defined by positions Pe where, in each cross-section E1, E2, E3 and so on that include a straight line N connecting the center of gravity G of the head and a sweet spot SS as shown in FIG. 3A, a radius of curvature r of an outline Lf of the outer surface of the face first reaches 200 mm when moving to face outward from the sweet spot side, as shown in FIG. 3B. Note that the sweet spot SS is the intersection between the face surface and a normal line (straight line N) of the face surface that passes through the center of gravity G of the head.

Also, in the present embodiment, the boundary between the sole portion 3 and the face portion 1 and between the sole portion 3 and the side portion 4 can be defined as follows. Specifically, if a ridge line is formed between the sole portion 3 and the face portion 1 and between the sole portion 3 and the side portion 4, that ridge line serves as the boundary. Also, although the golf club head according to the present embodiment has the side portion 4, in cases such as where, for example, the side portion 4 is not provided, the side portion 4 cannot be clearly distinguished and is included in the sole portion 3, or the sole portion 3 is directly connected to the crown portion 2, the ridge line between the sole portion 3 and the crown portion 2 serves as the boundary between both portions. Also, if a clear ridge line is not formed, the boundary is the outline that is seen when the head is placed in the reference state and viewed from directly above the center of gravity of the head 10. Note that, in consideration also of the case where the side portion cannot be clearly distinguished as described above, the "sole portion" according to the present invention is deemed to include the side portion.

Figure 4:
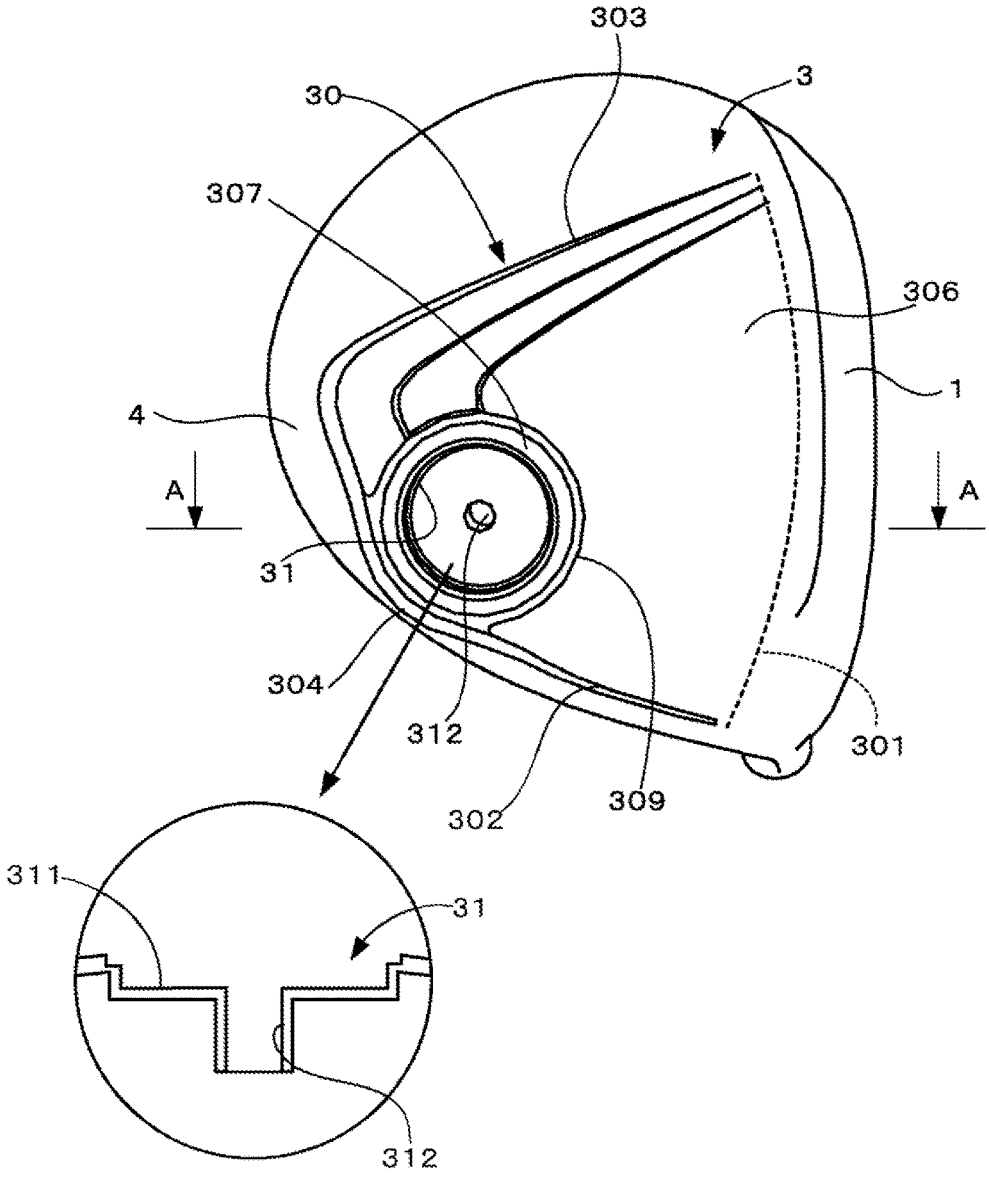
FIG. 4 is a bottom view of FIG. 1.

Next, the sole portion will be described. As shown in FIG. 4, a raised portion 30 protruding downward is formed on the sole portion 3. To be more specific, the raised portion 30 has a generally triangular shape formed by a first edge portion 301 that extends along generally the entirety of the face portion 1, along the vicinity of the boundary between the face portion 1 and the sole portion 3, a second edge portion 302 that extends from the vicinity of the hosel portion 5 to the vicinity of a midpoint in the toe-heel direction, along the vicinity of the boundary with the side portion 4 (or the crown portion 2), and a third edge portion 303 that extends diagonally to join an end portion of the first edge portion 301 on the toe side and an end portion of the second edge portion 302 on the toe side. To be more specific, either a step is not formed or only a slight step is formed in the first edge portion 301. In contrast, a clear step is formed in the second edge portion 302 and the third edge portion 303, and the steps are formed so as to increase in height, particularly toward the back side. At this time, the height of the rise in the second edge portion 302 and the third edge portion 303 can be 1 to 10 mm, for example. Accordingly, if the first edge portion 301 does not have a step, the first edge portion 301 can, for example, be a line that runs generally along the boundary between the face portion 1 and the sole portion 3 to join the end portions of the second edge portion 302 and the third edge portion 303. Note that, if the side portion 4 is not clearly formed, the second edge portion 302 can be an edge portion formed along the vicinity of the boundary between the sole portion 3 and the crown portion 2. Also, even if the side portion 4 is formed, the second edge portion 302 can also be formed to run along the boundary with the crown portion 2.

A circular recessed portion 31 is formed inside the raised portion 30. As described below, a decoration member 6 and a fixing member 7 for fixing this decoration member 6 in the recessed portion 31 are arranged in the recessed portion 31. Also, in order to fix the fixing member 7 in the recessed portion 31, a fixing hole 312 in which a female thread is formed is provided in the center of a bottom surface 311 of the recessed portion 31. The position of this fixing hole 312 is arranged further to the back side in the face-back direction and to the heel side in the toe-heel direction than the center of gravity of the head.

Furthermore, a part of the peripheral edge of the recessed portion 31 protrudes from the second edge portion 302 toward the heel side, and accordingly an arc-shaped protruding portion 304 that constitutes part of the peripheral edge of the recessed portion 31 is formed in the second edge portion 302.

Figure 5:
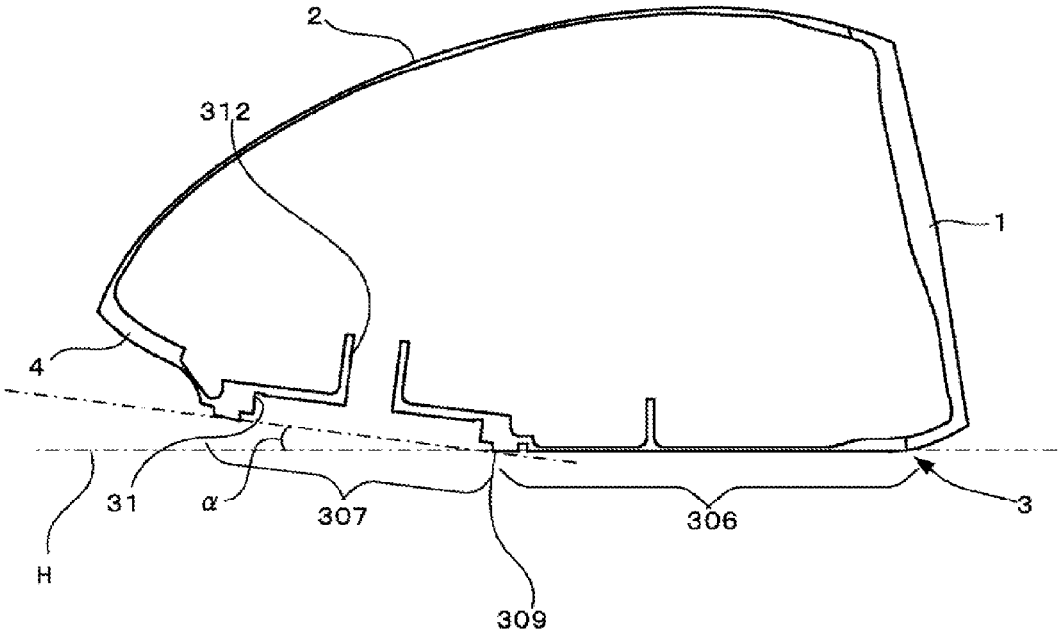
FIG. 5 is a cross-sectional view along an A-A line in FIG. 4 (cross-sectional view in a face-back direction passing through the center of a recessed portion)

Also, as shown in FIGS. 4 and 5, at least two regions are formed in the raised portion 30. Specifically, the regions include a placement region 306 that is connected to the face portion 1 and is placed on the ground H in the reference state, and a rear region 307 that is arranged further to the back side in the face-back direction than the placement region 306 and in which the recessed portion 31 is arranged. As described above, the placement region 306 is placed on the ground H, and is thus a flat region extending in at least the face-back direction from the vicinity of the boundary with the face portion 1 to the vicinity of the recessed portion 31. Also, as described above, the recessed portion 31 is formed in the rear region 307, and a boundary 309 between the placement region 306 and the rear region 307 is formed in an arc shape so as to run along the peripheral edge of the recessed portion 31 in the vicinity of the face portion 1 side of the recessed portion 31.

Thus, the rear region 307 extends so as to incline from the boundary 309 toward the back side. Specifically, the rear region 307 inclines so as to be oriented upward toward the back side. At this time, the rear region 307 and the placement region 306 are preferably connected so as to intersect each other at an angle $\alpha$ of approximately 4° to 10°. This is because, as described below, rigidity decreases and vibrations from the face portion 1 are fully transmitted to the rear region 307 if the angle $\alpha$ is less than 4°, and the center of gravity of the sole portion 3 is raised if the angle $\alpha$ is more than 10°.

The raised portion 30 is mainly arranged on the heel portion side of the sole portion 3, and when the head 10 in the reference state is seen in back view, at least 60% of the area of the raised portion 30 can be arranged further to the heel side than a line extending in the face-back direction through the furthest point on the back side of the sole portion 3. Note that the furthermost point on the back side of the sole portion 3 is specified from the outline of the head in the reference state when seen in back view.

The volume of this golf club head is, for example, preferably 300 $cm^3$ or more, more preferably 400 $cm^3$ or more, and particularly preferably 420 $cm^3$ or more. A head having such a volume serves to make the golfer feel more confident when the club is held at address, and also to increase the sweet spot area and the moment of inertia. Note that although an upper limit of the head volume is not particularly defined, in terms of practical use, it is, for example, desirably 500 $cm^3$ or less, and desirably 470 $cm^3$ or less when complying with R&A or USGA rules and regulations.

Also, the head can be formed from, for example, a titanium alloy (e.g., Ti-6Al-4V) having a specific gravity of approximately 4.4 to 4.5. Besides a titanium alloy, the head can be formed from one or a plurality of materials selected from among stainless steel, maraging steel, an aluminum alloy, a magnesium alloy, an amorphous alloy, and the like. Such a golf club head can be produced using various methods, and can, for example, be manufactured by casting using a known lost wax precision casting method or the like.

Note that the head according the present embodiment is configured by assembling a head body that has at least the sole portion 3 and another portion. For example, the head can be configured by constituting only the face portion 1 as a separate member and attaching the face portion 1 to the head body, or alternatively, the head can be configured by forming a head body with an opening provided in the crown portion 2 or the side portion 4 and blocking the opening with a separate member. Also, a cup face structure provided with a peripheral edge portion surrounding the face portion 1 can be employed.

2. Fixing Member

Figure 6A:
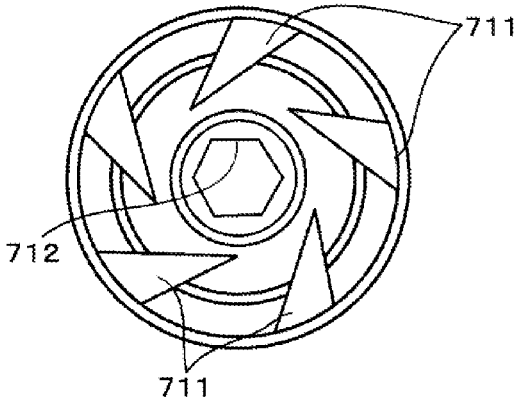
FIG. 6A is a plan view and FIG. 6B is a cross-sectional view of a fixing member.
Figure 6B:
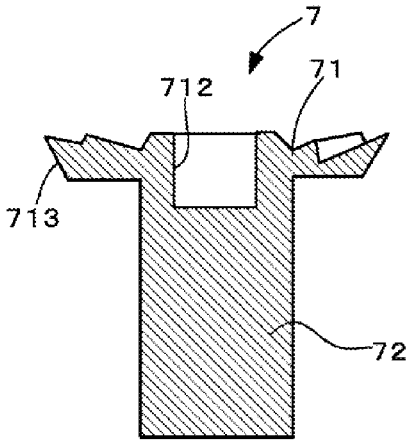

Next, the fixing member 7 will be described with reference to FIGS. 6A and 6B. FIG. 6A is a plan view and FIG. 6B is a cross-sectional view of the fixing member. For ease of description, the following description is based on the up-down direction in the drawings, but this direction does not necessarily limit the present invention. This point also applies to the following description of the decoration member 6 and attachment thereof.

As shown in FIGS. 6A and 6B, the fixing member 7 includes a disk-shaped head portion 71 and a shaft portion 72 that extends from the lower surface of the head portion 71. Also, the upper surface (externally facing surface or exposed surface) of the head portion 71 has been decorated. Specifically, on the upper surface of the head portion 71, a plurality of triangular recessed portions 711 that extend inward in the diameter direction from an outer peripheral edge thereof are formed at equal intervals. Also, at the center of the upper surface of the head portion 71, a tool hole 712 for inserting a tool such as a hex wrench or the like is formed. Furthermore, an outer peripheral surface 713 of the head portion 71 is formed with a taper whose diameter decreases downward. On the other hand, the shaft portion 72 is formed to have a columnar shape, and a male thread is formed on the outer peripheral surface thereof. This shaft portion 72 is configured to screw into the female thread of the fixing hole 312 of the recessed portion 31 formed in the aforementioned sole portion 3.

The material forming the fixing member 7 is not particularly limited, and a metal such as aluminum or stainless steel, a resin material or the like can be used, for example. Also, this fixing member 7 is used as a weight for adjustment. Specifically, a plurality of types of differently weighted fixing members 7 with substantially the same shape are prepared. The weight and the center of gravity of the head can then be changed by using one of the plurality of types of fixing members 7.

3. Decoration Member

Next, the decoration member 6 will be described with reference to FIGS. 7A and 7B. FIG. 7A is a plan view and FIG. 7B is a cross-sectional view of the decoration member.

Figure 7B:
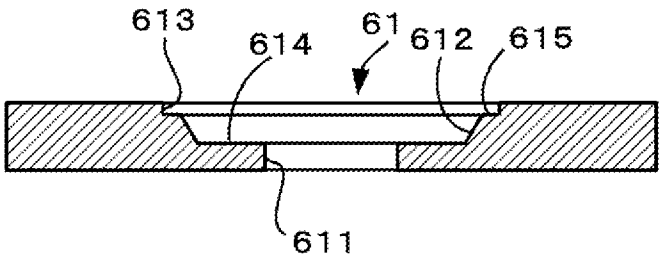
FIG. 7A is a plan view and FIG. 7B is a cross-sectional view of a decoration member.
Figure 7A:
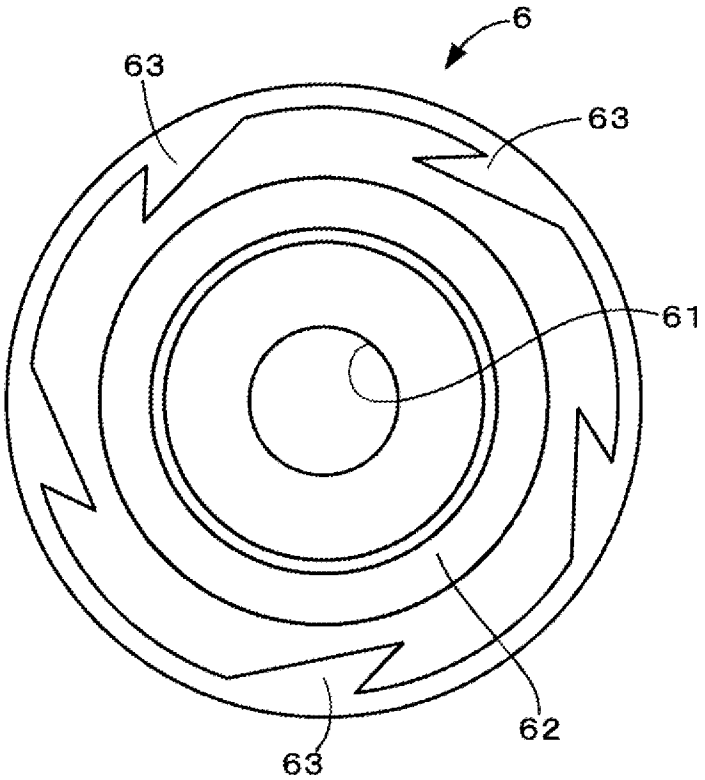

As shown in FIGS. 7A and 7B, the decoration member 6 is provided in order to decorate the sole portion 3. The decoration member 6 is formed to have a circular plate shape, and a through hole 61 is formed in the center thereof. The outer diameter of the decoration member 6 substantially matches the inner diameter of the recessed portion 31 of the sole portion 3, and the central through hole 61 is arranged in a position corresponding to the fixing hole 312 of the recessed portion 31. The upper surface of the decoration member 6 has been decorated, and decoration is possible with various methods. For example, decoration can be performed by coloring or forming a pattern with irregularities. In the example shown in FIGS. 7A and 7B, a ring 62 is formed around the through hole 61 and a plurality of triangular protruding portions 63 that extend inward in the diameter direction from an outer peripheral edge of the upper surface of the decoration member 6 form a pattern. A pattern is then formed on the upper surface of the decoration member 6 by shaving down the region excluding the ring 62 and the protruding portions 63 to form a recessed portion. Note that the protruding portions 63 of the decoration member 6 correspond to the recessed portions 711 of the fixing member 7, and achieve commonality in the pattern.

The through hole 61 is formed in order to attach the fixing member 7, and is constituted by three cylindrical regions. Specifically, the through hole 61 is constituted by a first portion 611 into which the shaft portion 72 of the fixing member 7 is to be inserted, a second portion 612 having a larger diameter than the first portion 611 and in which the head portion 71 is to be arranged, and a third portion 613 having a larger diameter than the second portion 612 and forming a gap on the peripheral edge of the head portion 71, and the first to third portions 611 to 613 are formed in the stated order so as to be continuous from the lower side to the upper side of the through hole 61.

The first portion 611 is formed with a slightly larger diameter than the shaft portion 72 of the fixing member 7. The second portion 612 has a larger diameter than the diameter of the first portion 611, and thus a first step portion 614 is formed between the second portion 612 and the first portion 611, and the lower surface of the head portion 71 of the fixing member 7 is configured to be placed on this first step portion 614. At this time, the depth of the first step portion 614 is prescribed such that the upper surface of the head portion 71 and the upper surface of the decoration member 6 are arranged generally on the same plane. Also, the inner wall surface of the second portion 612 is formed with a taper whose diameter decreases downward, and corresponds to the taper of the outer peripheral surface 713 of the head portion 71 of the fixing member 7.

The third portion 613 is formed with a slightly larger diameter than the diameter of the second portion 612, and when the head portion 71 of the fixing member 7 is mounted in the decoration member 6, the third portion 613 forms a gap with the peripheral edge of the head portion 71 of the fixing member 7. Specifically, a gap D is formed between the outer peripheral surface 713 of the head portion 71 and the inner wall surface of the third portion 613 (see FIG. 8). The width of the gap D is not particularly limited, and the gap D can be 0.1 to 2.0 mm, and more preferably 0.2 to 1.5 mm, for example. Also, a second step portion 615 is formed between the third portion 613 and the second portion 612, and this second step portion 615 is configured to be located at an intermediate portion of the mounted head portion 71 in the up-down direction.

The material forming the decoration member 6 is not particularly limited, and the decoration member 6 can also be formed with a metal such as stainless steel or aluminum, a resin material or the like, for example. Also, similarly to the fixing member 7, the decoration member 6 can be used as a weight for adjustment.

4. Attachment of Fixing Member and Decoration Member

Figure 8:
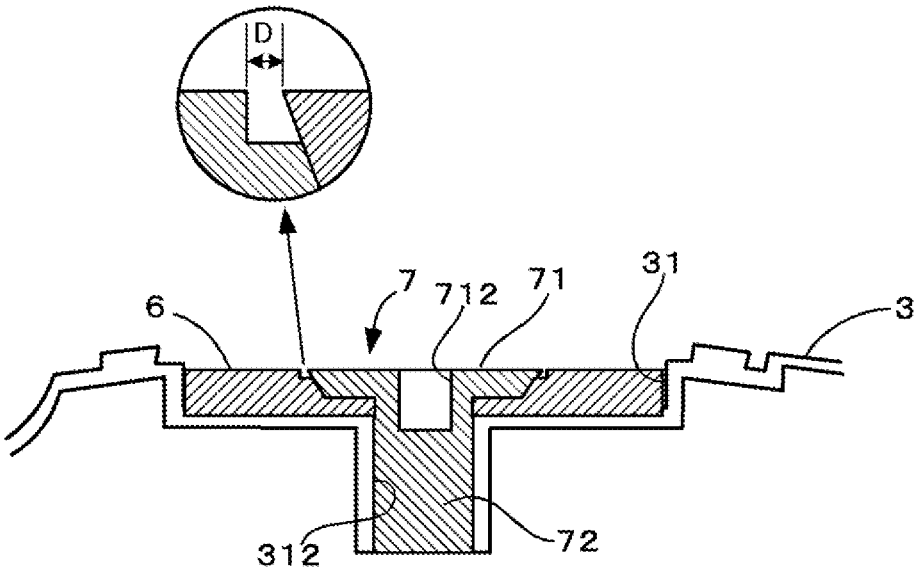
FIG. 8 is a cross-sectional view showing a state where the decoration member and the fixing member are attached to a sole portion.
Figure 9:
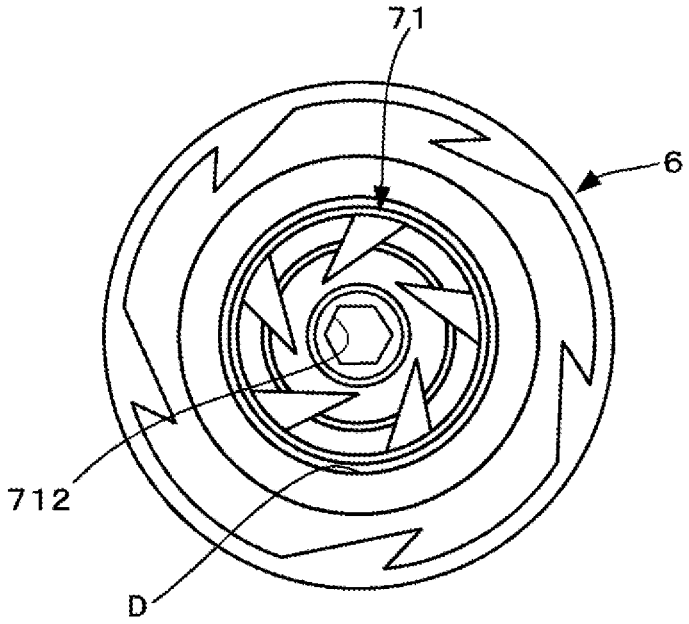
FIG. 9 is a plan view of FIG. 8.

Next, attachment of the fixing member and the decoration member will be described with reference to FIGS. 8 and 9. FIG. 8 is a cross-sectional view showing a state where the decoration member and the fixing member are attached to the sole portion, and FIG. 9 is a plan view of FIG. 8.

First, after an adhesive is applied to the lower surface of the decoration member 6, the decoration member 6 is arranged in the recessed portion 31 of the sole portion 3. Then, the fixing member 7 is arranged in the through hole 61 of the decoration member 6, and a hex wrench is inserted into the tool hole 712 of the upper surface of the fixing member 7 and rotated. The male thread of the shaft portion 72 of the fixing member 7 is thereby screwed into the female thread of the recessed portion 31. Then, when the fixing member 7 has been completely screwed in, the upper surface of the head portion 71 and the upper surface of the decoration member 6 are substantially level with each other. Attachment of the fixing member 7 and the decoration member 6 is thus completed, as shown in FIGS. 8 and 9.

5. Features

According to the present embodiment, as described above, the following effects can be obtained.

(1) The raised portion 30 protruding downward is formed on the sole portion 3, and thus the position of the center of gravity of the head 10 can be lowered. In particular, because the recessed portion 31 to which the fixing member 7 and the decoration member 6 that function as weights are attached is formed inside the raised portion 30, the center of gravity of the head can be further lowered. The hitting angle can thereby be increased and the flight distance can be lengthened. Also, the fixing member 7 and the decoration member 6 can be prevented from protruding by being arranged inside the raised portion 30, and thus these members can be prevented from catching on the ground when the club is swung.

(2) The center of the recessed portion 31 is further to the back side in the face-back direction than the center of gravity of the head, and thus the depth of the center of gravity is increased. Furthermore, because the recessed portion 31 is arranged on the heel side in the toe-heel direction, slicing is less likely to occur (so-called "ball holding" improves). Slicing can also be suppressed due to the raised portion 30 being formed to have a triangular shape as described above and being mainly arranged on the heel side of the sole portion 3.

(3) Even if the recessed portion 31 is arranged further to the back side in arranging the recessed portion 31 inside the raised portion 30, the recessed portion 31 can be housed inside the raised portion 30 due to the second edge portion 302 of the raised portion 30 protruding in an arc shape (protruding portion 304). Accordingly, the recessed portion 31 can be arranged on the back side, without impairing the design of the raised portion 30.

(4) The fixing member 7 and the decoration member 6 are both arranged in the recessed portion 31, and therefore the decoration member 6 can also be used as a weight.

(5) In the raised portion 30, the placement region 306 and the rear region 307 are formed in the face-back direction, and the rear region 307 inclines upward from the boundary 309 between both regions. Specifically, the two regions 306 and 307 are connected so as to bend at the boundary therebetween. For this reason, compared to when the two regions 306 and 307 are flatly connected, the rigidity of the raised portion 30 can be enhanced. The frequency of the vibration thereby increases when the ball is hit, and the pitch of the ball hitting sound can be raised. In particular, in the present embodiment, if the fixing member 7 and the decoration member 6 that function as weights are arranged in the vicinity of the antinode of vibration of the raised portion 30, the frequency of the vibration tends to decrease. Accordingly, such a structure is particularly advantageous in that, when an angle is given to the boundary 309 between the placement region 306 and the rear region 307 as described above, the rigidity of the raised portion that receives the vibration caused by hitting the ball is enhanced, and the pitch of the ball hitting sound can be raised.

6. Variations

Although an embodiment of the present invention has been described above, the present invention is not limited to the foregoing embodiment, and various modifications can be made without departing from the gist of the invention. The following are examples of modifications that can be made.

6.1

In the above embodiment, the raised portion 30 is formed to have a triangular shape, but the shape of the raised portion 30 is not particularly limited to this shape, as long as the recessed portion 31 is arranged inside the raised portion 30, and the center of the recessed portion 31 is arranged on the back side in the face-back direction and on the heel side in the toe-heel direction. Also, the height of the rise in the raised portion 30 is not particularly limited, and as described in the aforementioned embodiment, the height of the rise may be changed depending on location or set to a constant height in all places. It is preferable, however, for the raised portion 30 to be arranged on the heel side as a whole.

6.2

In the aforementioned embodiment, the placement region 306 and the rear region 307 are connected at an angle in the raised portion 30, but the regions do not necessarily need to be arranged in this manner, and the regions 306 and 307 may be flat.

6.3

In the aforementioned embodiment, both the fixing member 7 and the decoration member 6 are arranged in the recessed portion 31, but the golf club head according to the present invention is constituted even if only the fixing member 7 is arranged in the recessed portion 31, or even if neither the fixing member 7 nor the decoration member 6 is arranged in the recessed portion 31. Also, a plurality of recessed portions can be provided. Furthermore, the fixing member 7 and the decoration member 6 are not particularly limited in shape or fixing method, as long as they do not extend outside the recessed portion 31. Also, the recessed portion 31 may be other than circular, and may have a polygonal shape. Furthermore, the recessed portion 31 need only be arranged in the raised portion 30, and thus is not necessarily required to protrude from a peripheral portion.

6.4

In the aforementioned embodiment, a wood-type golf club was described, but the golf club according to the present invention is not limited to this. For example, the golf club may have a hollow head, such as so-called utility clubs and hybrid clubs.

REFERENCE SIGNS LIST

1 Face portion
2 Crown portion
3 Sole portion
30 Raised portion
301 First edge portion
302 Second edge portion
303 Third edge portion
304 Protruding portion
31 Recessed portion
6 Decoration member
7 Fixing member (weight member)
312 Fixing hole (center of recessed portion)

The invention claimed is:

1. A golf club head comprising:
a crown portion;
a face portion; and
a sole portion having at least one recessed portion;
wherein the recessed portion is configured to house a weight member such that the weight member does not protrude externally; and
wherein the sole portion includes:
a raised portion including the recessed portion and protruding downward, and to be at least partially placed on a placement surface in a reference state; and
a center of the recessed portion is arranged further to a back side in a face-back direction and to a heel side in a toe-heel direction than a center of gravity of the head;
wherein the raised portion is surrounded by a first edge portion that runs along a vicinity of a boundary between the sole portion and the face portion, a second edge portion that extends from the heel side to a vicinity of a midpoint in the toe-heel direction, along a vicinity of a boundary between the sole portion and the crown portion, and a third edge portion that joins an end portion of the second edge portion on a toe side and an end portion of the first edge portion on the toe side; and
wherein the second edge portion has a protruding portion formed by a part of a peripheral edge of the recessed portion protruding on the heel side.

2. A golf club head comprising:
a crown portion;
a face portion; and
a sole portion having at least one recessed portion,
wherein the golf club head further comprises a weight member that is to be arranged in the recessed portion, and wherein the recessed portion is configured to house the weight member such that the weight member does not protrude externally;
wherein the sole portion includes:
a raised portion including the recessed portion and protruding downward, and to be at least partially placed on a placement surface in a reference state; and
a center of the recessed portion is arranged further to a back side in a face-back direction and to a heel side in a toe-heel direction than a center of gravity of the head;
wherein the golf club head further comprises a decoration member that is to be arranged in the recessed portion; and
wherein the decoration member is fixed in the recessed portion by the weight member.

3. The golf club head according to claim 2, wherein, in a plane view, the decoration member is bigger than the weight member and has a step portion that houses the head portion of the weight member at the center thereof,
the head portion of the weight member is housed in the step portion of the decoration member.

4. The golf club head according to claim 3, wherein an exposed surface of the head portion of the weight member and an exposed surface of the decoration member are arranged on the same plane.

5. The golf club head according to claim 4, wherein the exposed surface of the weight member and the exposed surface of the decoration member coincide with an exposed surface of the sole portion.

6. The golf club head according to claim 4, wherein the expos exposed surface of the weight member and the exposed surface of the decoration member are positioned inside the exposed surface of the sole portion.

7. A golf club head comprising:
a crown portion;
a face portion;
a sole portion having at least one recessed portion; and
a decoration member that is to be arranged at the bottom surface of the recessed portion;
wherein the sole portion includes:
a raised portion including the recessed portion and protruding downward, and to be at least partially placed on a placement surface in a reference state; and
a center of the recessed portion is arranged further to a back side in a face-back direction and to a heel side in a toe-heel direction than a center of gravity of the head;
wherein the golf club head further comprises a weight member that is to be arranged in the recessed portion, and wherein the recessed portion is configured to house the weight member such that the weight member does not protrude externally;
wherein the recessed portion has a bottom surface that includes the center, the recessed portion has a fixing hole at the center of the bottom surface, wherein a size of the fixing hole is smaller than that of the recessed portion and that extends inward from the sole portion;
wherein the weight member has a shaft portion;
wherein the shaft portion of the weight member is fitted in the fixing hole;
wherein the weight member further has a head portion whose size is bigger than that of the shaft portion, the head portion of the weight member is arranged corresponding to the recessed portion;
wherein in a plane view, the decoration member is bigger than the weight member and has a step portion that houses the head portion of the weight member at the center thereof and a through hole at the center thereof, and
the decoration member is fixed at the bottom surface of the recessed portion by the head portion of the weight member being housed in the step portion of the decoration member and the shaft portion of the weight member being fitted in the through hole of the decoration member and the fixing hole of the recessed portion.

8. A golf club head comprising:

a crown portion;

a face portion; and a sole portion having at least one recessed portion, wherein the recessed portion is configured to house a weight member such that the weight member does not protrude externally, wherein the sole portion includes:

a raised portion including the recessed portion and protruding downward, and to be at least partially placed on a placement surface in a reference state; and a center of the recessed portion is arranged further to a back side in a face-back direction and to a heel side in a toe-heel direction than a center of gravity of the head; and wherein, when the head in the reference state is seen in back view, at least 60% of an area of the raised portion is arranged further to the heel side than a line extending in the face-back direction through a furthest point on the back side of the sole portion.

9. The golf club head according to claim 8, wherein, in a plane view of the sole portion, the recessed portion is formed to have circular shape.

10. The golf club head according to claim 9, wherein, in a plane view of the sole portion, the weight member is formed to have circular shape along the recessed portion.

* * * * *